US005328102A

United States Patent [19]

Babitzka et al.

[11] Patent Number: 5,328,102

[45] Date of Patent: Jul. 12, 1994

[54] ELECTROMAGNETIC FUEL METERING AND ATOMIZING VALVE

[75] Inventors: Rudolf Babitzka, Savigno; Marcello Cristiani, Imola; Gianni Fargnoli, Anzola Emilia, all of Italy

[73] Assignee: Weber S.r.l., Turin, Italy

[21] Appl. No.: 102,489

[22] Filed: Aug. 5, 1993

[30] Foreign Application Priority Data

Aug. 7, 1992 [IT] Italy ..... TO92A 000691

[51] Int. Cl.[5] ..... B05B 1/00

[52] U.S. Cl. ..... 239/585.4; 239/600

[58] Field of Search ..... 239/581-585.3, 239/585.4, 600

[56] References Cited

U.S. PATENT DOCUMENTS

| | | | |
|---|---|---|---|
| 4,101,074 | 7/1978 | Kinior | 239/585.4 |
| 4,230,273 | 10/1980 | Clacton et al. | 239/585.4 X |
| 4,423,842 | 1/1989 | Palma | 239/585.4 |
| 4,527,744 | 7/1985 | Hafner et al. | 239/585.3 |
| 4,582,085 | 4/1986 | Hafner et al. | 239/585.3 |
| 4,717,080 | 1/1988 | Sauer | 239/585.4 X |
| 5,263,649 | 4/1993 | Bubitzka et al. | 239/585.4 |

FOREIGN PATENT DOCUMENTS

| | | |
|---|---|---|
| 0196453 | 2/1986 | European Pat. Off. . |
| 4020188A1 | 1/1991 | Fed. Rep. of Germany . |
| 61-178553 | 8/1986 | Japan . |
| 63-176656 | 7/1988 | Japan . |

*Primary Examiner*—Andres Kashnikow
*Assistant Examiner*—Kevin P. Weldon
*Attorney, Agent, or Firm*—Baker & Daniels

[57] ABSTRACT

A valve substantially comprising a first tubular body having a wall of substantially constant thickness in which is formed at least a pair of openings; a second annular body incorporating an electromagnet and presenting a pair of radial projections, and a block forming a seat for an electric connecting element connected to the electromagnet, the projections being designed to fit inside the openings in the first body; and a third body defining an axial sleeve designed to fit inside the electromagnet for forming a core, and an annular collar projecting radially from the sleeve and designed to fit inside the wall of the first body.

15 Claims, 3 Drawing Sheets

ELECTROMAGNETIC FUEL METERING AND ATOMIZING VALVE

BACKGROUND OF THE INVENTION

The present invention relates to an electromagnetic fuel metering and atomizing valve for a vehicle fuel supply device.

Valves of the aforementioned type substantially comprise a plunger for controlling fuel flow through an injection orifice, and activated by a core energized by an annular electromagnet. The electromagnet and the plunger are housed in the top and bottom part of the valve body respectively, which parts are connected to each other in various ways, normally by means of welding or permanent deformation of the edges.

The valve body is closed at the top by a cap normally made of plastic material and having a block for seating an electric connecting element connected to the winding of the electromagnet.

The fuel injection orifice is normally formed in a metal plate welded to the bottom part of the body.

Valves of the aforementioned type present several drawbacks.

Firstly, fuel leakage may occur, due to the bottom surface of the plunger not resting properly on the corresponding surface of the plate in which the injection orifice is formed. This is mainly due to distortion of the plate when it is welded to the bottom part of the valve body, thus resulting in impaired mating of the plunger and plate surfaces.

Secondly, the performance of known valves of the aforementioned type is not particularly good, especially as regards the maximum to minimum fuel supply ratio of different injection cycles. This is due to the poor flux linkage generated in the magnetic circuit of which the electromagnet forms part, and consequently to the poor attraction exerted by the core on the plunger constituting the anchor of the circuit. The reason for this lies in the magnetic circuit being composed of several interconnected parts (in particular, the top and bottom parts of the valve body already mentioned), and in the fairly considerable distance between the electromagnet and circuit members.

Thirdly, known valves of the above type are invariably cumbersome and heavy, due to the large number and, in some cases, complex design of the component parts involved.

Lastly, assembly of known valves of the above type involves numerous operations requiring particular care and skill, thus resulting in fairly high cost and a poor degree of reliability.

SUMMARY OF THE INVENTION

It is an object of the present invention to provide an electromagnetic fuel metering and atomizing valve of the type briefly described above, designed to overcome the aforementioned drawbacks.

According to the present invention, there is provided an electromagnetic fuel metering and atomizing valve for a fuel supply device, comprising a plunger for controlling fuel flow through a fuel injection orifice; said plunger being activated by a core energized by an annular electromagnet; characterized by the fact that it comprises:

a first tubular body formed by means of permanent deformation and having a wall of substantially constant thickness; a top portion of said wall presenting at least one pair of openings;

a second annular body incorporating said electromagnet, and which presents a pair of radial projections, and a block forming a seat for an electric connecting element connected to said electromagnet; said block projecting from one of said projections, and each said projection being inserted inside a respective opening in said first body;

a third body defining an axial sleeve designed to fit inside said electromagnet for forming said core; and an annular collar projecting radially from said sleeve and designed to fit inside said top portion of said wall of said first body and over said second body;

means for securing said third body in a predetermined axial position in relation to said first body.

BRIEF DESCRIPTION OF THE DRAWINGS

A preferred non-limiting embodiment of the valve according to the present invention will be described by way of example with reference to the accompanying drawings, in which.

DETAILED DESCRIPTION OF THE INVENTION

Figure 1:
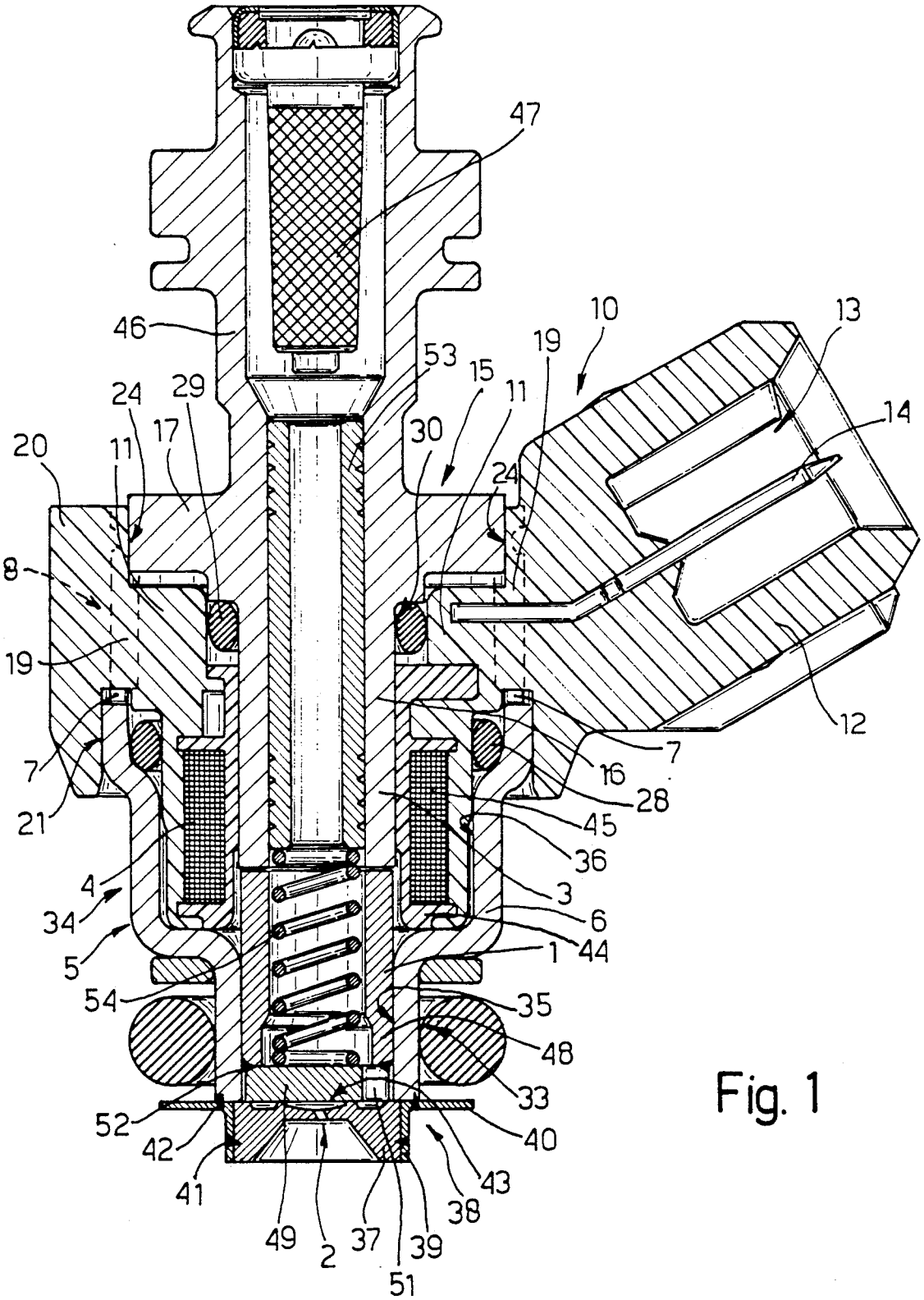
FIG. 1 shows an axial section of the valve according to the present invention.

With reference in particular to FIG. 1, the valve according to the present invention substantially comprises a plunger 1 for controlling fuel flow through an injection orifice 2 and activated by a core 3 energized by an annular electromagnet 4.

According to the present invention, the valve comprises a first tubular body 5 (shown in vertical section in FIG. 4) having a wall 6 of substantially constant thickness. Body 5 is formed by permanent deformation, e.g. by means of a series of drawing operations, and top portion 8 of wall 6 presents at least a pair of diametrically-opposed openings 7.

Figure 5:
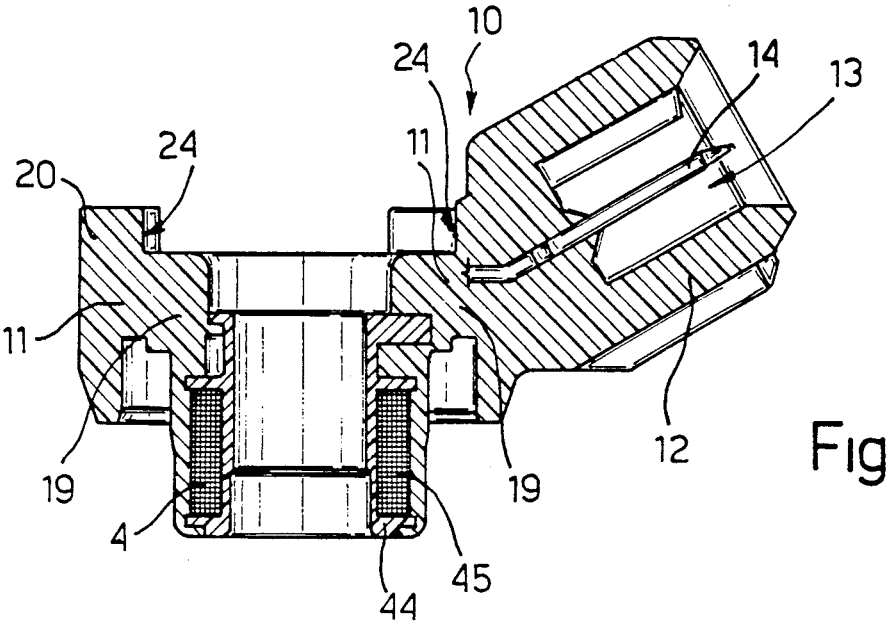
FIGS. 5 and 6 show a vertical section and top plan view respectively of a second body of the valve.
Figure 6:
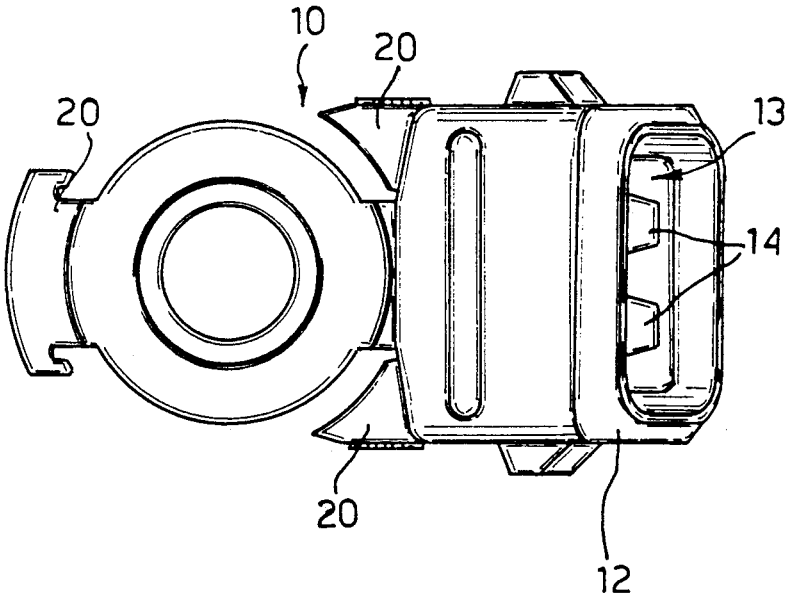

The valve according to the present invention also presents a second annular body 10 (FIGS. 5 and 6) incorporating electromagnet 4 and in turn presenting a pair of radial projections 11, and a block 12 forming a seat 13 for an electric connecting element 14 connected to the winding of electromagnet 4. As shown clearly in FIGS. 5 and 6, block 12 projects from one of projections 11, and is arranged facing upwards from one side of body 10. Each projection 11 is designed to fit inside a respective opening 7 of first body 5, as described later on.

The valve also comprises a third body 15 (FIG. 1) defining an axial sleeve 16, designed to fit inside electromagnet 4 for forming the core 3 of the valve, and an annular collar 17 projecting radially from sleeve 16 and designed to fit inside top portion 8 (FIG. 4) of first body 5 and over second body 10, as shown clearly in FIG. 1.

Figure 2:
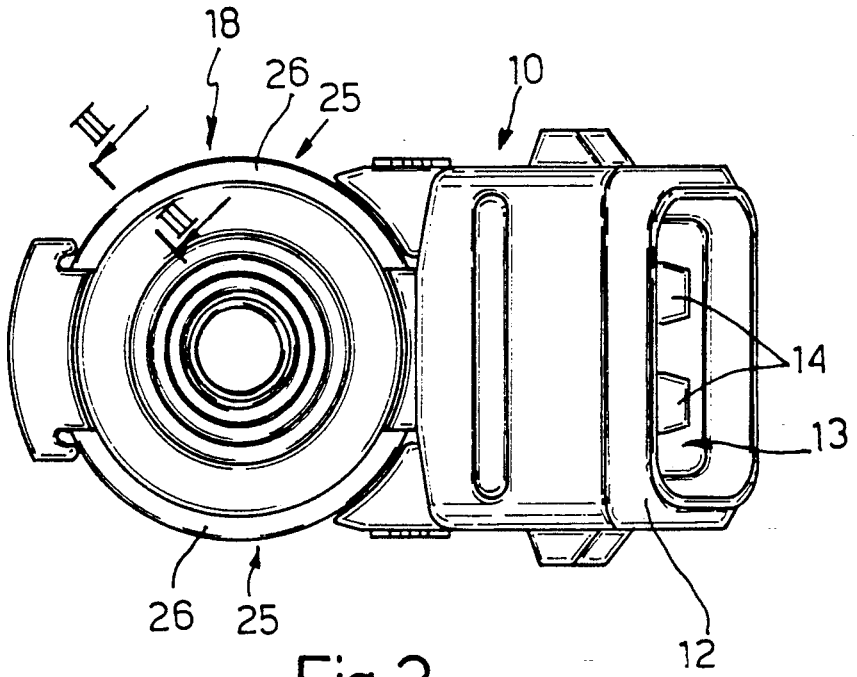
FIG. 2 shows a top plan view of the valve.
Figure 3:
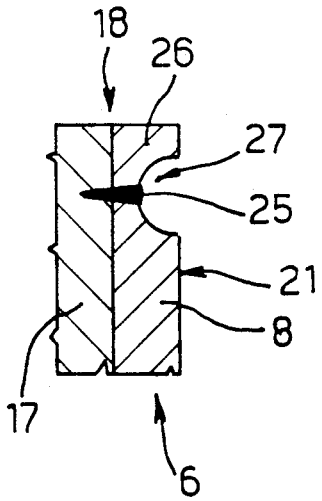
FIG. 3 shows a section of part of the valve along line III—III in FIG. 2.

The valve according to the present invention also comprises means 18 (FIGS. 2 and 3) for securing third body 15 in a predetermined axial position in relation to first body 5.

Each projection 11 (FIGS. 5, 6, 1) of second body 10 comprises a portion 19 designed to fit in a respective opening 7 of first body 5; and a head 20 designed to rest on an outer surface portion 21 (FIG. 1) of wall 6 of first body 5. Each head 20 comprises a cylindrical surface portion 24 (FIGS. 1 and 5) constituting a seat for annular collar 17 of third body 15.

Said means 18 for securing third body 15 in a predetermined axial position in relation to first body 5 substantially consist of a laser weld 25 (FIGS. 2 and 3) made between edge 26 of top portion 8 of wall 6 and annular collar 17 of third body 15. Outer surface 21 of top portion 8 of wall 6 conveniently presents a circumferential groove 27 inside which welds 25 are made; and, for ensuring correct welding, the depth of groove 27 is conveniently so selected as to leave a thickness of wall 6 ranging from 0.3 to 0.4 mm.

Between second body 10 and top portion 8 of wall 6 of first body 5, provision is made for a first annular sealing element 28 (FIG. 1); and a second annular sealing element 29 is inserted between sleeve 16 of third body 15 and an axial hole 30 of second body 10.

Figure 4:
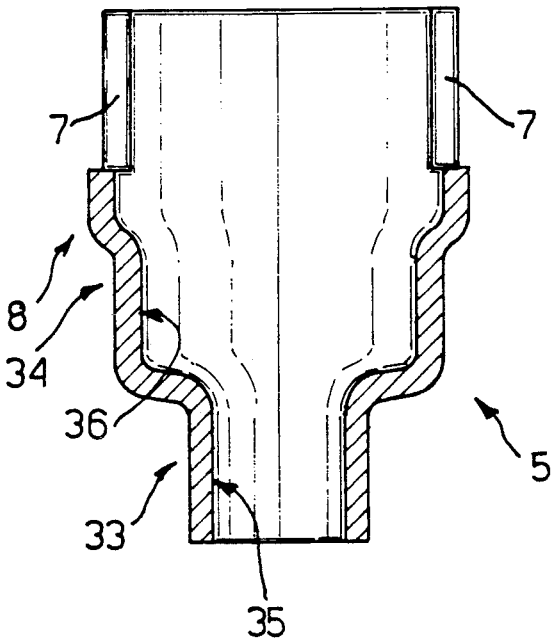
FIG. 4 shows a vertical section of a first body of the valve.

As shown clearly in FIG. 4, first body 5 comprises a bottom wall portion 33, a central wall portion 34, and said top wall portion 8, all blending with one another, and of which portion 33 presents a smaller inside diameter than portion 34, which in turn presents a smaller inside diameter than portion 8.

The inner cylindrical surface 35 (FIG. 1) of bottom wall portion 33 acts as a sliding seat for plunger 1, while surface 36 of central wall portion 34 acts as a seat for housing second body 10.

According to the present invention, fuel injection orifice 2 is formed in a disk 37 (FIG. 1) fitted to bottom wall portion 33 of first body 5 by means of an annular connecting element 38 presenting an annular collar 39, in which disk 37 is inserted, and a flange 40 perpendicular to the axis of collar 39, and projecting radially from the top edge of collar 39, as shown clearly in FIG. 1. Disk 37 is secured to collar 39 by means of a laser weld 41, and flange 40 to the edge of bottom portion 33 of wall 6 by means of a second laser weld 42. Before fitting the assembly consisting of disk 37 and connecting element 38 on to body 5, the upper surface 43 (FIG. 1) of the assembly is lapped to obtain a perfectly smooth, flat mating surface for the edge of bottom portion 33 of wall 6.

The outside diameter of disk 37 is between the inside and outside diameters of bottom wall portion 33 of first body 5, so that the annular connecting portion between disk 37 and connecting element 38 rests on the bottom edge of wall portion 33.

Second body 10 (FIGS. 5 and 6) comprises a spool 44 on which is formed a winding 45 for forming electromagnet 4, and is formed by injecting thermoplastic material over spool 44 and winding 45 and so incorporating them into body 10.

Sleeve 16 of third body 15 (FIG. 1) comprises a portion 46 projecting axially upwards from annular collar 17 and housing a fuel filtering element 47.

Plunger 1 conveniently comprises a cylindrical lateral wall 48 (FIG. 1) designed to slide inside surface 35 of bottom wall portion 33 of body 5; and a bottom wall 49 consisting of a disk having at least one opening 51 and connected to lateral wall 48 by a laser weld 52. Bottom wall 49 is designed to rest on upper surface 43 of the assembly consisting of disk 37 and annular connecting element 38. Finally, the valve comprises a tube 53 inserted inside sleeve 16 and constituting a stop for a coil spring 54 inserted inside plunger 1 for keeping it in the FIG. 1 position wherein injection orifice 2 is closed.

The valve described above is assembled and operates as follows.

First, the assembly consisting of disk 37 and annular connecting element 38 is secured to first body 5 by means of laser weld 42, during which, flange 40 of element 38 is subjected to only a small amount of heat, thus preventing distortion of disk 37. In particular, the geometry and surface finish of lapped upper surface 43 of the assembly remain unaffected, so that the bottom surface of bottom wall 49 of plunger 1 (subsequently fitted together with spring 54 inside body 5) rests correctly on surface 43, thus providing for perfect sealing between plunger 1 and surface 43.

The next step consists in inserting second body 10 followed by third body 15. For inserting second body 10, portions 19 of projections 11 are inserted inside respective openings 7 of body 5; and body 10 is centered perfectly on body 5 by heads 20 resting on surface portion 21 (FIG. 1) of body 5. Bodies 10 and 15 are secured stably to body 5 by means of laser weld 25 (FIGS. 2 and 3), for which purpose top portion 8, into which collar 17 of second body 10 is inserted, is deformed elastically (this is permitted by openings 7) so as to bring portion 8 and collar 17 together, at which point the weld is made. Prior to welding, the axial position of third body 15 in relation to the other two may of course be adjusted to achieve a given travel of plunger 1, the limit stop of which in fact consists of the bottom edge of sleeve 16.

As already stated, no in-service fuel leakage occurs between plunger 1 and mating surface 43, by virtue of the plunger resting correctly on surface 43, and the correct guiding action provided for by surface 35 of bottom wall portion 33. Moreover, response of the valve and the maximum to minimum fuel supply ratio of different injection cycles (dynamic range) are particularly good, due to the high flux linkage of the plunger, in turn due to the short length and low flux resistance of the magnetic circuit. First body 5, in fact, consists of a single metal piece, and therefore presents very little flux resistance; while, by virtue of the structure of the valve, electromagnet 4 is extremely close to the members forming the magnetic circuit.

By virtue of the structure and small number of component parts of the valve, this is fairly compact (in terms of length and maximum diameter) as well as extremely lightweight, so that very little space is required for installation. Moreover, assembly of the valve involves only a few straightforward operations, by virtue of consisting of components and assemblies which may be prepared prior to assembly.

Finally, the valve according to the present invention provides for a high degree of reliability as well as low-cost production.

To those skilled in the art it will be clear that changes may be made to both the design and arrangement of the component parts of the embodiment described and illustrated herein without, however, departing from the scope of the present invention.

Figure 7:
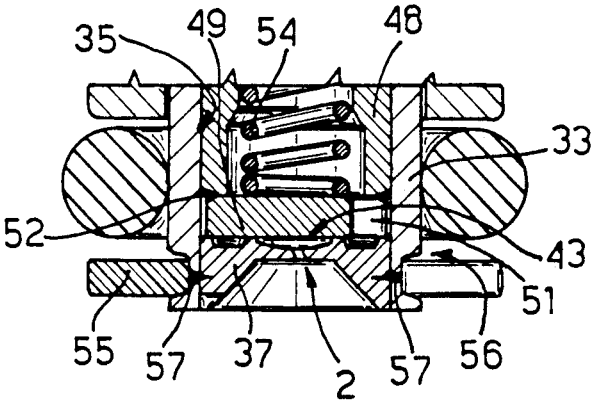
FIG. 7 shows an axial section of the bottom portion of a second embodiment of the valve according to the present invention.

In particular, disk 37 may be secured to bottom portion 33 of wall 6 of body 5 as shown in FIG. 7, wherein disk 37 is connected to wall 35 of portion 33 by means of a laser weld 57 effected inside an annular groove 56 conveniently housing a washer 55 with a radial opening.

Also, the top and cylindrical lateral surfaces of plunger 1 may be coated with a hard metal layer of predetermined thickness, e.g. galvanically deposited chromium, for better defining the radial clearance between the plunger and sliding surface 35, and the axial clearance in relation to core 3 (air gap), as well as for reducing friction between the plunger and the sliding surface.

We claim:

1. An electromagnetic fuel metering and atomizing valve for a fuel supply device, comprising a plunger (1) for controlling fuel flow through a fuel injection orifice (2); said plunger (1) being activated by a core (3) energized by an annular electromagnet (4); characterized by the fact that it comprises:

a first tubular body (5) formed by means of permanent deformation and having a wall (6) of substantially constant thickness; a top portion (8) of said wall (6) presenting at least one pair of openings (7);

a second annular body (10) incorporating said electromagnet (4), and which presents a pair of radial projections (11), and a block (12) forming a seat (13) for an electric connecting element (14) connected to said electromagnet (4); said block (12) projecting from one of said projections (11), and each said projection (11) being inserted inside a respective opening (7) in said first body (5);

a third body (15) defining an axial sleeve (16) designed to fit inside said electromagnet (4) for forming said core (3); and an annular collar (17) projecting radially from said sleeve (16) and designed to fit inside said top portion (8) of said wall (6) of said first body (5) and over said second body (10);

means (18) for securing said third body (15) in a predetermined axial position in relation to said first body (5).

2. A valve as claimed in claim 1, characterized by the fact that each said projection (11) of said second body (10) comprises a portion (19) designed to fit inside a respective opening (7) of said first body (7); and a head (20) designed to rest on an outer surface portion (21) of said wall (6) of said first body (5); each said head (20) comprising a cylindrical surface portion (24) constituting a seat for said annular collar (17) of said third body (15).

3. A valve as claimed in claim 1, characterized by the fact that said means (18) for securing said third body (15) in a predetermined axial position in relation to said first body (5) consist of a laser weld (25) made between the edge of said top portion (8) of said wall (6) of said first body (5) and said annular collar (17) of said third body (15).

4. A valve as claimed in claim 3, characterized by the fact that the outer surface (21) of said top portion (8) of said wall (6) of said first body (5) presents an annular groove (27) in which said weld (25) is made.

5. A valve as claimed in claim 1, characterized by the fact that a first annular sealing element (28) is provided between said second body (10) and said top portion (8) of said wall (6) of said first body (5).

6. A valve as claimed in claim 1, characterized by the fact that a second annular sealing element (29) is provided between said sleeve (16) of said third body (15) and an axial hole (30) of said second body (10).

7. A valve as claimed in claim 1, characterized by the fact that said wall (6) of said first body (5) comprises a bottom wall portion (33), a central wall portion (34), and said top wall portion (8); said bottom wall portion (33) having a smaller inside diameter than said central wall portion (34), and said central wall portion (34) having a smaller inside diameter than said top wall portion (8).

8. A valve as claimed in claim 7, characterized by the fact that the inner cylindrical surface (35) of said bottom wall portion (33) acts as a sliding seat for said plunger (1), while the inner surface (36) of said central wall portion (34) acts as a seat for housing said second body (10).

9. A valve as claimed in claim 1, characterized by the fact that said fuel injection orifice (2) is formed in a disk (37) secured to a bottom wall portion (33) of said first body (5) by means of an annular connecting element (38) presenting an annular collar (39) in which said disk (37) is inserted, and a flange (40) perpendicular to the axis of and projecting radially from the top edge of said collar (39); said disk (37) being secured to said collar (39) by a first laser weld (41), and said flange (40) being secured to the edge of said bottom portion (33) of said wall (6) of said first body (5) by a second laser weld (42).

10. A valve as claimed in claim 9, characterized by the fact that an upper surface (43) of an assembly consisting of said disk (37) and said annular connecting element (38) is lapped subsequent to effecting said first weld (41), to obtain a perfectly smooth, flat mating surface for said edge of said bottom portion (33) of said wall (6) of said first body (5).

11. A valve as claimed in claim 9, characterized by the fact that the outside diameter of said disk (37) is between the inside and outside diameters of said bottom wall portion (33) of said first body (5).

12. A valve as claimed in claim 1, characterized by the fact that said second body (10) comprises a spool (44) on which is formed a winding (45) for said electromagnet (4); said second body (10) being formed by injecting thermoplastic material over said spool (44) and said winding (45) and so incorporating them in said second body (10).

13. A valve as claimed in claim 1, characterized by the fact that said sleeve (16) of said third body (15) comprises a portion (46) projecting axially upwards from said annular collar (17) and housing a fuel filtering element (47).

14. A valve as claimed in claim 7, characterized by the fact that said plunger (1) comprises a cylindrical lateral wall (48) designed to slide inside a surface (35) of said bottom portion (33) of said wall (6) of said first body (5); and a bottom wall (49) consisting of a disk having at least one opening (51) and connected to said lateral wall (48) by a laser weld (52); said bottom wall (49) being designed to rest on an upper surface (43) of an assembly consisting of said disk (37) and said annular connecting element (38).

15. A valve as claimed in claim 1, characterized by the fact that it comprises a tube (53) inserted inside said sleeve (16) and constituting a stop for a spring (54) inserted inside said plunger (1) and which provides for maintaining said plunger (1) in the closed position wherein said injection orifice (2) is closed.

* * * * *